US007704451B2

(12) United States Patent
Kuroda et al.

(10) Patent No.: US 7,704,451 B2
(45) Date of Patent: Apr. 27, 2010

(54) ALUMINUM ALLOY SHEET, METHOD FOR PRODUCING THE SAME, AND ALUMINUM ALLOY CONTAINER

(75) Inventors: Kenji Kuroda, Moka (JP); Etsuko Kuroda, legal representative, Moka (JP); Takashi Inaba, Moka (JP)

(73) Assignee: Kobe Steel, Ltd., Kobe-shi (JP)

( * ) Notice: Subject to any disclaimer, the term of this patent is extended or adjusted under 35 U.S.C. 154(b) by 855 days.

(21) Appl. No.: 11/109,637

(22) Filed: Apr. 20, 2005

(65) Prior Publication Data

US 2006/0240270 A1 Oct. 26, 2006

(51) Int. Cl.
*C22C 21/08* (2006.01)
*C22C 21/06* (2006.01)
*C22F 1/04* (2006.01)

(52) U.S. Cl. ..... 420/534; 148/439; 148/552

(58) Field of Classification Search ..... 420/528, 420/529, 533, 534; 148/437–440
See application file for complete search history.

(56) References Cited

FOREIGN PATENT DOCUMENTS

| | | |
|---|---|---|
| JP | 64-68439 | 3/1989 |
| JP | 4-214845 | 8/1992 |
| JP | 6-33205 | 2/1994 |
| JP | 8-269607 | 10/1996 |
| JP | 11-100629 | 4/1999 |
| JP | 11-158574 | 6/1999 |
| JP | 2002-256366 | 9/2002 |

OTHER PUBLICATIONS

Davis et al., Materials for Rolling: Nonferrous Materials-ASM Handbook, 1988, ASM International, 9th Edition, vol. 14, p. 355.*
I. Ohashi, et al. "Development of "DAKARA" Aluminum Bottle Can", JPI Journal, 2000, vol. 38, No. 9, pp. 868-875.

* cited by examiner

*Primary Examiner*—Roy King
*Assistant Examiner*—Caitlin Fogarty
(74) *Attorney, Agent, or Firm*—Oblon, Spivak, McClelland, Maier & Neustadt, L.L.P.

(57) ABSTRACT

An aluminum alloy sheet contains 0.1% to 0.4% by mass of Cu, 0.5% to 1.5% by mass of Mg, 0.5% to 1.5% by mass of Mn, 0.2% to 0.7% by mass of Fe, and 0.1% to 0.3% by mass of Si. The number density of Al—Mn—Fe—Si-based intermetallic compound having a maximum length of 8 to 15 μm per unit area is 179 grains/mm$^2$ or less. An oxide film having an average thickness of 30 nm or less is formed on the surface of the aluminum alloy sheet. The arithmetic average roughness Ra of the surface of the aluminum alloy sheet is 0.30 to 0.45 μm.

3 Claims, 2 Drawing Sheets

ALUMINUM ALLOY SHEET, METHOD FOR PRODUCING THE SAME, AND ALUMINUM ALLOY CONTAINER

BACKGROUND OF THE INVENTION

1. Field of the Invention

The present invention relates to an aluminum alloy sheet that is particularly suitable for, for example, DI cans and bottle cans and that causes no longitudinal streaks when subjected to severe necking.

2. Description of the Related Art

Aluminum alloy sheets are widely used as the materials for containers such as a variety of beverage cans in terms of, for example, formability, corrosion resistance, and strength. Aluminum alloy sheets are subjected to, for example, drawing and ironing (hereinafter referred to as "DI process") to form alumina cans for containers (hereinafter referred to as "DI cans"). DI cans having various shapes have been increasingly developed with the increasing need for such cans.

An aluminum alloy often used for DI cans is Al—Mn-based 3004 alloy (JIS 4000). The composition of the alloy is adjusted to provide desired properties. The alloy is processed into an aluminum alloy sheet having a predetermined thickness through the steps of casting, homogenization, hot rolling, cold rolling, annealing, and final cold rolling.

The aluminum alloy sheet thus produced is subjected to a can shaping process such as cupping and DI process to form a body portion. The body portion is then necked so that an end opening has a smaller diameter than the body portion, thus producing a DI can as shown in FIG. 2. FIG. 2 is a schematic perspective view of a conventional DI can having a stepped neck.

In FIG. 2, a DI can 11 has a body portion 12, a neck portion 13 formed at a predetermined position of the body portion 12, and an opening 14 at the end of the neck portion 13. This DI can 11 is integrally formed as a two-piece DI can by DI process. The bottom of the body portion 12 on the opposite side of the opening 14 is formed continuously with the body portion 12.

The degree of reduction R2 in the diameter D4 of the opening 14 relative to the diameter D3 of the body portion 12 (hereinafter referred to as "degree of diameter reduction") is represented by the formula R2=[(D3−D4)/D3]×100%. For the DI can 11, the opening 14 at the end of the neck portion 13 has a smaller diameter than the body portion 12.

In the current mainstream of DI can manufacturing, the top of a DI can is processed by multistage die necking to form an end opening having a smaller diameter. Accordingly, the DI process has been performed to a severer degree of processing.

In DI can manufacturing, an aluminum alloy sheet is subjected to the DI process with, for example, a die. In this process, the sheet subjected to ironing, which is a relatively severe process, may decrease partially in surface smoothness depending on the lubrication conditions between the die and the sheet, namely the conditions of the contact portions of the die and the sheet and the conditions of the lubricant applied to the sheet by a lubricator. Roughness and dust may then occur at the contact portions of the aluminum alloy sheet and the die. This may result in a poor appearance due to fine streaks extending in the ironing direction on the outer surface of a DI can (hereinafter referred to as "longitudinal streaks").

The main factors responsible for such longitudinal streaks occurring on the outer surface of a DI can include the surface roughness of the aluminum alloy sheet and the size and number density per unit area of intermetallic compound. The longitudinal streaks also occur on the outer surface of a DI can when the type or amount of lubricant applied to the aluminum alloy sheet is unsuitable at a pressing step in the DI can manufacturing. In addition, the occurrence of the longitudinal streaks is affected by the material properties, surface lubricity, and seizure resistance of the portion of the sheet brought into contact with the die.

The following techniques have been proposed to inhibit such longitudinal streaks from occurring on the outer surfaces of DI cans.

(1) Japanese Unexamined Patent Application Publication No. 64-68439, for example, proposes an aluminum alloy sheet for cans which has a composition adjusted to suitably control the diameter and distribution of intermetallic compounds and the surface properties of the sheet, thereby inhibiting longitudinal streaks.

According to this publication, the aluminum alloy sheet has significantly high resistance to longitudinal streaks, and can therefore inhibit them effectively even under poor lubrication conditions in cup shaping.

(2) Japanese Unexamined Patent Application Publication No. 4-214845, for example, proposes a method for producing an aluminum alloy sheet having a finer microstructure by adjusting its composition and optimizing the production conditions.

According to this publication, the resultant aluminum alloy sheet has high strength and formability, excellent ironability and formability (necking and flanging) after coating and printing (baking), and excellent properties against Luder's lines occurring on the sidewall of a drawn cup before ironing and constriction at a corner of the cup.

(3) Japanese Unexamined Patent Application Publication No. 11-100629, for example, proposes an aluminum alloy sheet for cans which has a composition adjusted to have predetermined surface roughness and is coated with a lubricant having proper viscosity and insulation resistance by electrostatic application.

According to this publication, the aluminum alloy sheet has high formability and proper lubricity to inhibit longitudinal streaks from occurring on the outer surfaces of DI cans without lubrication by a lubricator, which needs complicated maintenance.

The known techniques disclosed in the above publications are applied to DI cans having a wide body portion relative to an end opening (with a degree of diameter reduction of 9% or less, namely (D3−D4)/D3×100% in FIG. 2).

On the other hand, there is a growing need for bottle-shaped cans (hereinafter referred to as "bottle cans") produced by the same method as for producing DI cans and having a body portion, an opening, and a screw cap. Such bottle cans are exemplified by a bottle can 1 shown in FIG. 1. This DI can 1 has a body portion 2, a neck portion formed 3 at a predetermined position of the body portion 2, and an opening 4 at the end of the neck portion 3. The body portion 2, the neck portion 3, and the bottom of the DI can 1 are integrally formed by DI process as a two-piece DI can. The periphery of the opening 4 is threaded to form a screw portion for cap attachment. The bottom of the body portion 2 on the opposite side of the opening 4 is formed continuously with the body portion 2.

The degree of reduction R1 in the diameter D2 of the opening 4 relative to the diameter D1 of the body portion 2 (degree of diameter reduction) is represented by the formula R1=[(D1−D2)/D1]×100%.

For the bottle can 1, the opening 4 at the end of the neck portion 3 has a much smaller diameter than the body portion 2, namely a degree of diameter reduction R1 of 30% or more.

Accordingly, the bottle can 1 is subjected to DI process to a much severer degree of processing than conventional DI cans as shown in FIG. 2.

If longitudinal streaks occur on the outer surface of a bottle can at an ironing step in the bottle can manufacturing process, and the diameter of an end opening thereof is reduced to some extent at a necking step following the ironing step, the longitudinal streaks concentrate on relatively narrow areas of the outer surface of the bottle can. In particular, generally, a bottle can has a high degree of reduction in the diameter of its top opening, namely 30% or more, in the necking step. The longitudinal streaks are therefore emphasized with significantly developed irregularities after the necking step even if they are slight and nearly invisible before the necking step.

Thus longitudinal streaks occur on the outer surfaces of bottle cans after necking more readily than on the outer surfaces of conventional DI cans, which have relatively low degrees of diameter reduction.

In addition, the top end of a bottle can is threaded to form a helical groove for cap attachment, is curled outward, and is hermetically sealed with a cap. Longitudinal streaks occurring at the curled end result in higher surface roughness which decreases the hermeticity between the can and the cap. As a result, the contents sealed in the bottle can leak more readily.

Thus aluminum alloy sheets capable of sufficiently inhibiting longitudinal streaks have been strongly demanded for severer processes such as DI process, necking, and curling in bottle can manufacturing.

In bottle can manufacturing, a can produced by DI process is washed and treated by chemical conversion coating, such as chromating, for higher corrosion resistance.

Subsequently, the outer surface of the can is coated with a paint containing a base resin, such as epoxy resin, polyester resin, and acrylic resin, and a crosslinking agent to form a basecoat and a clear coat with a thickness of about 5 to 10 μm.

On the other hand, the inner surface of the can is coated with a solvent-based paint, such as epoxy-phenol paint, epoxy-urea paint, and vinyl organosol paint, or a water-based paint containing acrylic-modified epoxy resin by spraying. The applied paint is baked in an oven to form a coating with a diameter of about 3 to 5 μm.

The can with the inner and outer coatings is necked to a high degree of diameter reduction, and is threaded to form a bottle can.

The inner and outer surfaces of the can are subjected to different processes in the above steps.

The outer surface of the can is brought into direct contact with a die. In the ironing step, particularly, the thickness of the can is reduced by a tapered portion of the die. As a result, intermetallic compounds inside the aluminum alloy are exposed at the surface of the can, and therefore come into contact with the die.

On the other hand, the inner surface of the can is not brought into contact with the die, but is drawn along the surface of a punch in the ironing step. The intermetallic compounds inside the aluminum alloy sheet are therefore not exposed at the inner surface of the can. The conditions of the inner surface are associated with intermetallic compounds exposed at the surface of the aluminum alloy sheet from the beginning.

If, particularly, the inner coating of the can is defective, the contents come into direct contact with the aluminum alloy. The contact may cause the dissolution or corrosion of the aluminum alloy and thus leak the contents after a long period of time. In general, evaluation parameters typified by enamel rate value (ERV) are employed to evaluate the inner coating of bottle cans for defects.

In the evaluation of the inner coating of a bottle can for defects by ERV, for example, the ERV is determined by filling the can with a solution containing physiological saline and a surfactant, supplying the can with a predetermined direct voltage between the solution and the outer surface of the can, and measuring the current flowing between them with an ammeter. ERV increases with increasing number of coating defects at the inner surface of the bottle can. The present inventors have estimated the number of coating defects by measuring the ERV of the inner surface of the bottle can, and have studied ERV for sufficiently few coating defects at the inner surface of the bottle can. The studies show that the inner coating of the bottle can requires an ERV of 10 mA or less when the can contains an acidic, highly corrosive solution containing chloride ions.

The present inventors have also studied in detail the relationship between longitudinal streaks occurring on the outer surface of the bottle can and coating defects occurring on the inner surface of the bottle can. The results show that, if the ERV exceeds 10 mA, coating defects often occur on the inner surface of the bottle can even with no visible longitudinal streaks occurring on the outer surface of the bottle can.

SUMMARY OF THE INVENTION

In light of the above problems, an object of the present invention is to provide an aluminum alloy sheet allowing the production of a container that causes no longitudinal streaks around its end opening even if the opening is necked to a higher degree of diameter reduction, and that has excellent ERV properties.

Intensive studies by the present inventors have found that the above object can be achieved by optimizing the composition of the aluminum alloy used, controlling the size and number density per unit area of intermetallic compound included in the aluminum alloy, and controlling the structure, average oxide film thickness, and arithmetic average roughness Ra of the aluminum alloy within the optimum ranges, thus achieving the present invention.

That is, the present invention provides an aluminum alloy sheet containing 0.1% to 0.4% by mass of Cu, 0.5% to 1.5% by mass of Mg, 0.5% to 1.5% by mass of Mn, 0.2% to 0.7% by mass of Fe, and 0.1% to 0.3% by mass of Si. The number density of Al—Mn—Fe—Si-based intermetallic compound having a maximum length of 8 to 15 μm per unit area is 179 grains/$mm^2$ or less. An oxide film having an average thickness of 30 nm or less is formed on the surface of the aluminum alloy sheet. The arithmetic average roughness Ra of the surface of the aluminum alloy sheet is 0.30 to 0.45 μm.

The contents of Cu, Mg, Mn, Fe, and Si in the aluminum alloy sheet are controlled to improve its formability. In addition, the number density of Al—Mn—Fe—Si-based intermetallic compound having a maximum length of 8 to 15 μm per unit area and the average oxide film thickness are controlled to inhibit seizure on dies in, for example, DI process, the amount of dust produced, and longitudinal streaks on the outer surfaces of container products. Furthermore, the arithmetic average roughness Ra is controlled to inhibit coating defects on the inner surfaces of container products. If, for example, this aluminum alloy sheet is used to produce a bottle can, no longitudinal streaks occur on the outer surface of the can even after severe necking with a 30% or more reduction in the diameter of an end opening of the can. In addition, the inner surface of the bottle can has excellent ERV properties to cause no leakage of the contents from between the opening after curling and a cap.

"ERV properties" herein refer to the magnitude of the ERV of the inner surface of a bottle can measured in the manner described above. "Excellent ERV properties" mean that the inner coating of a bottle can has sufficiently few defects for practical use.

Experiments by the present inventors have demonstrated that the "excellent ERV properties" of the inner surface of a bottle can correspond to an ERV of 10 mA or less.

The arithmetic average roughness Ra of the surface of the aluminum alloy sheet according to the present invention is measured in a direction perpendicular to the rolling direction of the sheet by the method according to JIS B 0601. The above Al—Mn—Fe—Si-based intermetallic compounds with a maximum length of 8 to 15 μm include those exposed at the surface of the sheet and those inside the sheet. The number density of Al—Mn—Fe—Si-based intermetallic compound with a maximum length of 8 to 15 μm per unit area refers to the number of the grains per unit area on the surface of the sheet or at a certain depth.

The present invention provides another aluminum alloy sheet containing 0.1% to 0.4% by mass of Cu, 0.5% to 1.5% by mass of Mg, 0.5% to 1.5% by mass of Mn, 0.2% to 0.7% by mass of Fe, and 0.1% to 0.3% by mass of Si. The number density of Al—Mn—Fe—Si-based intermetallic compound having a maximum length of 10 μm or more per unit area is 67 grains/mm$^2$ or less. An oxide film having an average thickness of 30 nm or less is formed on the surface of the aluminum alloy sheet. The arithmetic average roughness Ra of the surface of the aluminum alloy sheet is 0.30 to 0.45 μm.

The contents of Cu, Mg, Mn, Fe, and Si in the aluminum alloy sheet are controlled to improve its formability. In addition, the number density of Al—Mn—Fe—Si-based intermetallic compound having a maximum length of 10 μm or more per unit area and the average oxide film thickness are controlled to inhibit seizure on dies in, for example, DI process, the amount of dust produced, and longitudinal streaks on the outer surfaces of container products. Furthermore, the arithmetic average roughness Ra is controlled to inhibit coating defects on the inner surfaces of container products. If, for example, this aluminum alloy sheet is used to produce a bottle can, no longitudinal streaks occur on the outer surface of the can even after severe necking with a 30% or more reduction in the diameter of an end opening of the can. In addition, the inner surface of the bottle can has excellent ERV properties to cause no leakage of the contents from between the opening after curling and a cap.

The present invention further provides a method for producing the above two types of aluminum alloy sheets. This method includes the steps of scalping a cast aluminum alloy slab to remove the surface thereof, which includes a coarse cell layer; homogenization; and rolling. In this method, the scalping step is a pretreatment step for the homogenization step and the rolling step.

Segregated portions, particularly a coarse cell layer, occur in slab casting before the homogenization step and the rolling step because of the heterogeneous distribution of the alloy elements added in the slab. According to the above method, such segregated portions can be removed to achieve the above two types of aluminum alloy sheets.

That is, the above method can produce an aluminum alloy sheet that has the above contents of Cu, Mg, Mn, Fe, and Si, that includes Al—Mn—Fe—Si-based intermetallic compounds with a maximum length of 8 to 15 μm at a number density of 179 grains/mm$^2$ or less, preferably those with a maximum length of 10 μm or more at a number density of 67 grains/mm$^2$ or less, that has an average oxide film thickness of 30 nm or less, and that has an arithmetic average roughness Ra of 0.30 to 0.45 μm.

As described above, the aluminum alloy sheets according to the present invention are excellent as the materials for containers because the sheets have good ironability and ERV properties and cause no leakage.

The present invention further provides an aluminum alloy container produced from an aluminum alloy sheet containing 0.1% to 0.4% by mass of Cu, 0.5% to 1.5% by mass of Mg, 0.5% to 1.5% by mass of Mn, 0.2% to 0.7% by mass of Fe, and 0.1% to 0.3% by mass of Si. The number density of Al—Mn—Fe—Si-based intermetallic compound having a maximum length of 8 to 15 μm per unit area in the aluminum alloy sheet is 179 grains/mm$^2$ or less. An oxide film having an average thickness of 30 nm or less is formed on the surface of the aluminum alloy sheet. The arithmetic average roughness Ra of the surface of the aluminum alloy sheet is 0.30 to 0.45 μm. This aluminum alloy container has a cylindrical body portion and a neck portion formed by necking, wherein $(D1-D2)/D1\times100\geqq30$, wherein D1 is the diameter of the body portion and D2 is the diameter of the neck portion.

The present invention provides another aluminum alloy container produced from an aluminum alloy sheet containing 0.1% to 0.4% by mass of Cu, 0.5% to 1.5% by mass of Mg, 0.5% to 1.5% by mass of Mn, 0.2% to 0.7% by mass of Fe, and 0.1% to 0.3% by mass of Si. The number density of Al—Mn—Fe—Si-based intermetallic compound having a maximum length of 10 μm or more per unit area in the aluminum alloy sheet is 67 grains/mm$^2$ or less. An oxide film having an average thickness of 30 nm or less is formed on the surface of the aluminum alloy sheet. The arithmetic average roughness Ra of the surface of the aluminum alloy sheet is 0.30 to 0.45 μm. This aluminum alloy container has a cylindrical body portion and a neck portion formed by necking, wherein $(D1-D2)/D1\times100\geqq30$, wherein D1 is the diameter of the body portion and D2 is the diameter of the neck portion.

DESCRIPTION OF THE PREFERRED EMBODIMENTS

Figure 1:
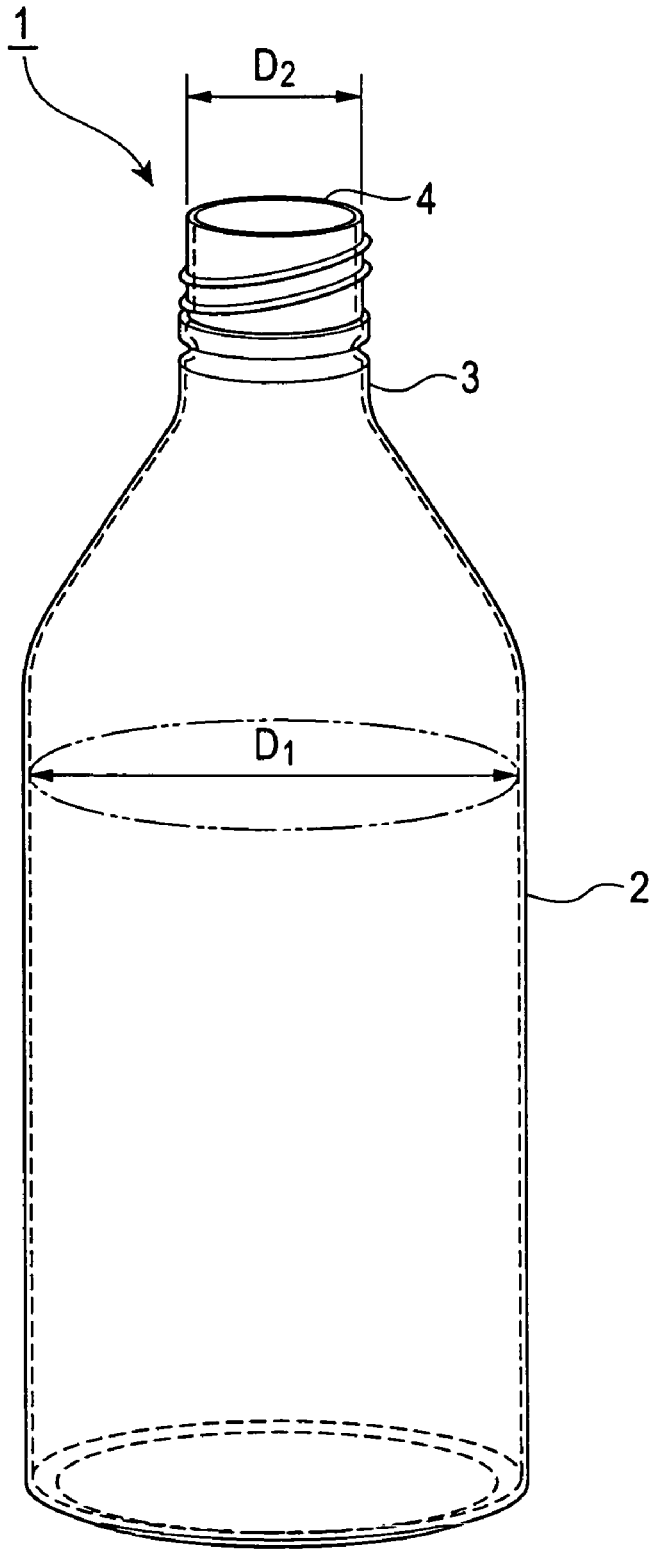
FIG. 1 is a schematic diagram of a bottle can that can be produced with an aluminum alloy sheet according to the present invention.

Embodiments of the present invention will now be described in detail.

An aluminum alloy sheet according to the present invention may be produced by any known method. In this embodiment, for example, the aluminum alloy sheet is produced as follows. Al—Mn-based 3004 alloy (JIS 4000) is processed by direct-chill (DC) casting to prepare a slab. The slab is then subjected to homogenization and hot rolling to form an aluminum alloy sheet. The aluminum alloy sheet is subjected to cold rolling and annealing a predetermined number of times, and is then subjected to final cold rolling to produce an aluminum alloy sheet with a desired thickness according to the present invention.

The composition of the aluminum alloy sheet, the size and number density per unit area of Al—Mn—Fe—Si-based intermetallic compound, the average thickness of an oxide film formed on the sheet, and the arithmetic average roughness Ra of the surface of the sheet are controlled as follows:

[Cu content: 0.1% to 0.4% by mass]

Cu contained in the aluminum alloy sheet according to the present invention is an element contributing to material strength. Cu dissolves into the aluminum alloy during the annealing in the production process described above. If, therefore, the aluminum alloy sheet is applied to DI cans or bottle cans, Cu precipitates to provide hardness for such products in the step of baking a coating after can shaping. In the present invention, the content of Cu is 0.1% to 0.4% by mass. If the content of Cu is less than 0.1% by mass, the sheet has difficulty in achieving the desired material strength. If, on the other hand, the content of Cu is more than 0.4% by mass, the sheet exhibits excessive strength and thus lower formability.

[Mg content: 0.5% to 1.5% by mass]

Mg contained in the aluminum alloy sheet according to the present invention is another element contributing to material strength. In the present invention, the content of Mg is 0.5% to 1.5% by mass. If the content of Mg is less than 0.5% by mass, the sheet has difficulty in achieving the desired strength. If, on the other hand, the content of Mg is more than 1.5% by mass, the sheet exhibits a higher degree of work hardening and thus lower formability.

[Mn content: 0.5% to 1.5% by mass]

Mn contained in the aluminum alloy sheet according to the present invention contributes to material strength and serves to form Al—Mn—Fe—Si-based intermetallic compounds to prevent the sheet from adhering to a die in ironing. In the present invention, the content of Mn is 0.5% to 1.5% by mass, preferably 0.7% to 1.5% by mass. If the content of Mn is less than 0.5% by mass, the sheet includes an insufficient amount of Al—Mn—Fe—Si-based intermetallic compounds formed, and therefore cannot achieve the desired strength. If, on the other hand, the content of Mn is more than 1.5% by mass, the sheet exhibits excessive strength and contains coarse Al—Mn—Fe—Si-based intermetallic compounds which tend to cause defects in a deep streak pattern on the inner surface of a container product in ironing. As a result, the inner coating of the container product has lower adhesiveness and ERV properties.

[Fe content: 0.2% to 0.7% by mass]

Also, Fe contained in the aluminum alloy sheet according to the present invention serves to form Al—Mn—Fe—Si-based intermetallic compounds to prevent the sheet from adhering to a die in ironing. In the present invention, the content of Fe is 0.2% to 0.7% by mass, preferably 0.35% to 0.50% by mass. If the content of Fe is less than 0.2% by mass, the sheet has difficulty in forming Al—Mn—Fe—Si-based intermetallic compounds with a maximum length of 2 μm or more, which are required to prevent the sheet from adhering to a die. If, on the other hand, the content of Fe is more than 0.7% by mass, the sheet includes extremely large Al—Mn—Fe—Si-based intermetallic compounds with a maximum length exceeding 20 μm. Such coarse grains tend to cause tear off (the phenomenon in which the body portion of a can ruptures during ironing) and defects in a deep streak pattern on the inner surface of a container product in ironing. As a result, the inner coating of the container product has lower adhesiveness and ERV properties.

[Si content: 0.1% to 0.3% by mass]

Si contained in the aluminum alloy sheet according to the present invention combines with Al—Mn—Fe-based intermetallic compounds in the homogenization to form Al—Mn—Fe—Si-based intermetallic compounds, which have higher strength. In the present invention, the content of Si is 0.1% to 0.3% by mass. If the content of Si is less than 0.1% by mass, the sheet includes an insufficient amount of Al—Mn—Fe—Si-based intermetallic compounds formed. If, on the other hand, the content of Si is more than 0.3% by mass, Si adversely affects the material strength and the behavior of recrystallization.

[Unavoidable Impurities]

As unavoidable impurities, the aluminum alloy sheet according to the present invention may contain 0.1% or less by mass of Cr, 0.5% or less by mass of Zn, 0.1% or less by mass of Ti, 0.1% or less by mass of Zr, and 0.1% or less by mass of B. Such unavoidable impurities do not inhibit the effects of the present invention.

[Size and Number Density Per Unit Area of Al—Mn—Fe—Si—Based Intermetallic Compound: 179 or Less Grains with Maximum Length of 8 to 15 μm Per Square Millimeter]

The Al—Mn—Fe—Si-based intermetallic compounds included in the aluminum alloy sheet according to the present invention have extremely high strength and serve as a solid lubricant for a die in ironing to prevent seizure due to the adhesion of the sheet to the die. In the present invention, the number density of Al—Mn—Fe—Si-based intermetallic compound with a maximum length of 8 to 15 μm per unit area is 179 grains/mm$^2$ or less. Preferably, the number density of Al—Mn—Fe—Si-based intermetallic compound with a maximum length of 10 μm or more per unit area is 67 grains/mm$^2$ or less. If the sheet includes Al—Mn—Fe—Si-based intermetallic compounds with a maximum length of 8 to 15 μm at a number density exceeding 179 grains/mm$^2$, the surface of a die is readily roughened to cause longitudinal streaks on the outer surface of a container product, and tear off occurs more readily due to decreased ironability. For a necked container such as a bottle can, additionally, ERV properties decrease because coating defects occur more readily on the inner surface of the container. When, for example, a can is removed from a punch after ironing, the punch rubs against Al—Mn—Fe—Si-based intermetallic compounds exposed at the inner surface of the can. The surface of the punch is therefore readily roughened if the sheet includes Al—Mn—Fe—Si-based intermetallic compounds with a maximum length of 8 to 15 μm at a number density exceeding 179 grains/mm$^2$. This may result in problems such as decreased punch life.

In general, Al—Mn—Fe—Si-based intermetallic compounds having smaller diameters are more readily formed. The size distribution of the grains is indicated by an upward-sloping curve with the maximum length put on the horizontal axis (increasing rightward) and the number of grains put on the vertical axis (increasing upward). In the present invention, the composition of the aluminum alloy, the rolling conditions, and the annealing-conditions, for example, are preferably suitably controlled so that the sheet includes Al—Mn—Fe—Si-based intermetallic compounds with a maximum length of 8 to 15 μm at a number density of 179 grains/mm$^2$ or less, preferably those with a maximum length of 10 μm or more at a number density of 67 grains/mm$^2$ or less. In particular, the cooling rate decreases at a coarse cell layer formed during the casting. The coarse cell layer therefore causes intermetallic compounds to grow more readily, and thus forms coarse intermetallic compounds. The coarse cell layer is normally removed at a scalping step. If, however, the coarse cell layer cannot be sufficiently removed because of the thickness of the layer and the shape of the slab, coarse intermetallic compounds are left at the surface of the slab. The coarse cell layer must therefore be removed so that the distribution of the intermetallic compound stays within the numerical range according to the present invention.

[Average oxide film thickness: 30 nm or less]

The oxide film formed on the surface of the aluminum alloy sheet according to the present invention is mainly composed of $Al_2O_3$, and its thickness varies according to the conditions of, for example, homogenization, hot rolling, and cold rolling. If the oxide film has an excessive thickness, the sheet, for example, readily seizes on a die in DI process. This results in a larger amount of dust produced to cause longitudinal streaks on the outer surface of a container product.

In the present invention, therefore, the average thickness of the oxide film formed on the surface of the aluminum alloy sheet is controlled to 30 nm or less to inhibit the longitudinal streaks.

[Arithmetic average roughness Ra: 0.30 to 0.45 μm]

The arithmetic average roughness Ra (JIS B 0601), which is a factor controlling the surface roughness of the aluminum alloy sheet according to the present invention, plays an important role in the contact between the sheet and a die for shaping the sheet into a container. That is, an aluminum alloy sheet with higher arithmetic average roughness Ra produces a larger amount of dust in severe processes such as drawing and ironing to increase the degree of contamination of the die and coolant (oil used in ironing) used. Consequently, continuous pressing gradually produces unsatisfactory container products with rougher inner and outer surfaces.

Coating defects on the inner surface of the container products depend on, for example, the pretreatment conditions of the aluminum alloy sheet, the type of coating, and particularly the surface conditions of the aluminum alloy sheet before coating. In the present invention, the arithmetic average roughness Ra of the surface of the aluminum alloy sheet is controlled to 0.30 to 0.45 μm so that the substrate, namely the aluminum alloy sheet, can induce an anchor effect on the coating formed on the sheet to ensure sufficient adhesion between the sheet and the coating. Such adhesion inhibits coating defects even if the coated sheet is subjected to severe processes such as necking.

If the arithmetic average roughness Ra exceeds 0.45 μm, the sheet has a smaller anchor effect on the coating and therefore exhibits lower adhesiveness to the coating. As a result, coating defects occur readily on the inner surfaces of bottle cans produced by severe processes such as necking.

If, on the other hand, the arithmetic average roughness Ra is 0.30 to 0.45 μm, a sufficiently small amount of dust is produced in severe processes such as drawing and ironing. The amount of dust produced is nearly constant with an arithmetic average roughness Ra below 0.30 μm. Even if the arithmetic average roughness Ra is controlled below 0.30 μm, no significant improvement is achieved in the inhibition of longitudinal streaks from occurring on the outer surface of cans produced by severe processes. In addition, the production of an aluminum alloy sheet with an arithmetic average roughness Ra below 0.30 μm requires a mirror-finished, less rough roll which results in a higher cost and lower productivity due to easy roll slip in rolling.

In the present invention, therefore, the arithmetic average roughness Ra of the surface of the aluminum alloy sheet is controlled to 0.30 to 0.45 μm.

Figure 2:
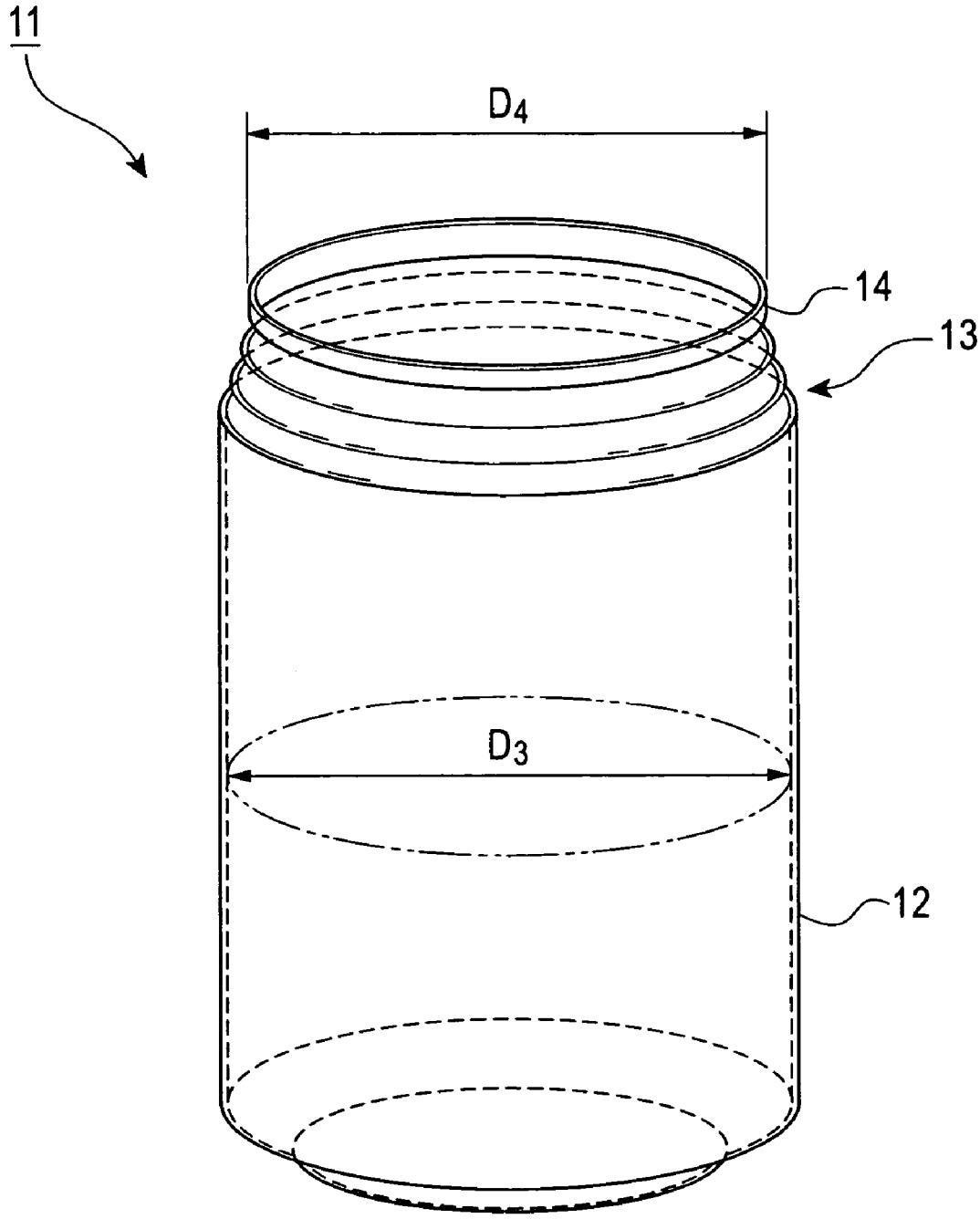
FIG. 2 is a schematic diagram of a DI can having a stepped neck.

The aluminum alloy sheet composed as described above in the present invention may be applied to various aluminum cans including, for example, the bottle can shown in FIG. 1 and the DI can shown in FIG. 2.

Next, a description is given of a method for producing the aluminum alloy sheet according to the present invention and the necessity for a scalping step to remove the surface of an aluminum alloy slab, which includes a coarse cell layer.

The cooling rate usually decreases at a coarse cell layer formed on the slab in casting. The coarse cell layer therefore causes intermetallic compounds to grow more readily, and thus forms coarse intermetallic compounds. A large number of such coarse grains result in problems such as a roughened die surface which causes longitudinal streaks on the outer surface of container products and decreased ERV properties due to coating defects on the inner surface of necked containers such as bottle cans.

In the method for producing the aluminum alloy sheet according to the present invention, the additives described above, namely 0.1% to 0.4% by mass of Cu, 0.5% to 1.5% by mass of Mg, 0.5% to 1.5% by mass of Mn (preferably, 0.7% to 1.5% by mass), 0.2% to 0.7% by mass of Fe (preferably, 0.35% to 0.50% by mass), and 0.1% to 0.3% by mass of Si, are added to aluminum, which is cast into an aluminum alloy slab. The surface of the slab is scalped in an amount larger than that in normal scalping process to completely remove the coarse cell layer. An aluminum alloy sheet is produced after the subsequent steps including rolling. According to this method, the coarse cell layer of the slab can be completely removed to provide an aluminum alloy sheet including Al—Mn—Fe—Si-based intermetallic compounds with a maximum length of 8 to 15 μm at a number density of 179 grains/$mm^2$ or less, preferably those with a maximum length of 10 μm or more at a number density of 67 grains/$mm^2$ or less. In addition, the oxide film formed on the aluminum alloy sheet has an average thickness of 30 nm or less. Furthermore, the arithmetic average roughness Ra of the surface of the aluminum alloy sheet is 0.30 to 0.45 μm.

EXAMPLES

First Set of Examples

A first set of examples of the aluminum alloy sheet according to the present invention will now be specifically described in contrast with comparative examples that do not meet the requirements for the present invention.

An ingot of Al—Mn-based 3004 alloy (JIS 4000) was subjected to the steps of normal casting, homogenization, hot rolling, and cold rolling to prepare test pieces of varying types of aluminum alloy sheets with a thickness of 0.32 mm. The formability of these test pieces was evaluated.

Table 1 shows the evaluation results of the composition, the number density of Al—Mn—Fe—Si-based intermetallic compound with a maximum length of 8 to 15 μm per unit area, the arithmetic average roughness Ra, the average oxide film thickness, the ironability, the ERV properties, and the leakage rate for the test pieces of each type of aluminum alloy sheet.

In the first set of examples, in Table 1, the aluminum alloy sheets of Examples 1 to 6 contained 0.1% to 0.4% by mass of Cu, 0.5% to 1.5% by mass of Mg, 0.5% to 1.5% by mass of Mn, 0.2% to 0.7% by mass of Fe, and 0.1% to 0.3% by mass of Si, and the balance was composed of Al and unavoidable impurities. These aluminum alloy sheets included Al—Mn—Fe—Si-based intermetallic compounds with a maximum length of 8 to 15 μm at a number density of 179 grains/$mm^2$ or less. In addition, oxide films formed on the aluminum alloy sheets had an average thickness of 30 nm or less. Furthermore, the arithmetic average roughness Ra of the surfaces of the aluminum alloy sheets was 0.30 to 0.45 μm. On the other hand, the aluminum alloy sheets of Comparative Examples 7 to 21 did not meet the above requirements for the present invention.

The individual types of test pieces having the properties shown in Table 1 were prepared under varying conditions, for example varying temperatures and processing times, at the individual steps of casting, homogenization, hot rolling, and cold rolling. The averages of the conditions were as follows: homogenization: homogenization temperature=590° C.; hot rolling: hot finish rolling/coiling temperature=320° C.; cold rolling: cold rolling/coiling temperature=140° C.; roll surface roughness Ra=0.48 μm.

TABLE 1

| Category | No. | Composition (mass %) Si | Fe | Mn | Mg | Cu | Intermetallic compound with maximum length of 8 to 15 μm (grains/mm$^2$) | Surface roughness Ra (μm) | Average oxide film thickness (nm) | Ironability | ERV properties (mA) | Leakage rate |
|---|---|---|---|---|---|---|---|---|---|---|---|---|
| Example | 1 | 0.27 | 0.44 | 0.90 | 0.90 | 0.20 | 116 | 0.38 | 18 | Good | 0.0 | 0/20 |
| | 2 | 0.25 | 0.42 | 0.88 | 0.91 | 0.23 | 98 | 0.38 | 18 | Good | 0.0 | 0/20 |
| | 3 | 0.27 | 0.48 | 1.15 | 1.20 | 0.23 | 112 | 0.38 | 18 | Good | 0.0 | 0/20 |
| | 4 | 0.29 | 0.43 | 0.90 | 0.92 | 0.21 | 103 | 0.38 | 18 | Good | 0.0 | 0/20 |
| | 5 | 0.27 | 0.44 | 0.94 | 0.89 | 0.20 | 176 | 0.38 | 18 | Good | 1.7 | 0/20 |
| | 6 | 0.28 | 0.45 | 0.95 | 0.92 | 0.21 | 168 | 0.38 | 18 | Good | 0.9 | 0/20 |
| Comparative example | 7 | 0.08 | 0.44 | 0.90 | 0.90 | 0.20 | 70 | 0.38 | 18 | Fair | 0.0 | 1/20 |
| | 8 | 0.50 | 0.44 | 0.90 | 0.90 | 0.23 | 115 | 0.38 | 18 | Fair | 12.7 | 2/20 |
| | 9 | 0.27 | 0.15 | 0.90 | 0.90 | 0.20 | 67 | 0.38 | 18 | Fair | 1.8 | 0/20 |
| | 10 | 0.26 | 0.85 | 0.89 | 0.90 | 0.22 | 210 | 0.38 | 18 | Fair | 15.5 | 5/20 |
| | 11 | 0.27 | 0.44 | 0.36 | 0.90 | 0.20 | 50 | 0.38 | 18 | Poor | 0.0 | 0/20 |
| | 12 | 0.27 | 0.44 | 1.55 | 0.90 | 0.22 | 192 | 0.38 | 18 | Fair | 22.8 | 3/20 |
| | 13 | 0.27 | 0.44 | 0.90 | 0.30 | 0.20 | 105 | 0.38 | 18 | Good | 0.0 | 0/20 |
| | 14 | 0.26 | 0.44 | 0.89 | 2.05 | 0.20 | 121 | 0.38 | 18 | Poor | 0.0 | 0/20 |
| | 15 | 0.27 | 0.44 | 0.90 | 0.89 | 0.04 | 101 | 0.38 | 18 | Good | 0.0 | 0/20 |
| | 16 | 0.27 | 0.44 | 0.91 | 0.90 | 0.42 | 107 | 0.38 | 18 | Poor | 0.1 | 0/20 |
| | 17 | 0.27 | 0.44 | 0.90 | 0.95 | 0.20 | 180 | 0.38 | 18 | Good | 14.3 | 3/20 |
| | 18 | 0.26 | 0.42 | 0.92 | 0.94 | 0.19 | 112 | 0.49 | 15 | Good | 0.0 | 2/20 |
| | 19 | 0.26 | 0.42 | 0.92 | 0.94 | 0.19 | 112 | 0.58 | 15 | Good | 0.2 | 4/20 |
| | 20 | 0.26 | 0.42 | 0.92 | 0.94 | 0.19 | 112 | 0.40 | 35 | Good | 0.0 | 2/20 |
| | 21 | 0.26 | 0.42 | 0.92 | 0.94 | 0.19 | 112 | 0.42 | 47 | Good | 0.0 | 3/20 |

Subsequently, the aluminum alloy sheets shown in Table 1 were used to produce DI cans as follows.

The aluminum alloy sheets were subjected to cupping to prepare cans having a blank diameter of 140 mm and a cup diameter of 90 mm. These cans were then subjected to redrawing at 250 spm and to ironing three times with a final ironing ratio of 39% to produce DI cans having a thickness of 105 μm, a body diameter of 66 mm, and a height of 123 mm.

In this process, 10,000 DI cans were continuously produced. Of the cans produced by the continuous processing, the final 20 cans were washed and subjected to zirconium phosphate conversion coating. The inner surfaces of the cans were then coated with an acrylic-modified epoxy paint by spraying. The cans were necked (into the shape of the bottle can shown in FIG. 1; degree of diameter reduction: 42%) and were threaded to produce bottle cans.

The resultant test pieces, DI cans, and bottle cans of the aluminum alloy sheets were evaluated for Items A to F below.

The test pieces, DI cans, and bottle cans of the aluminum alloy sheets were evaluated as follows:

[A. Measurement of Size and Number Density Per Unit Area of Al—Mn—Fe—Si-Based Intermetallic Compound]

The size and number density per unit area of Al—Mn—Fe—Si-based intermetallic compound were measured by the following procedure:

(1) The surfaces of the test pieces of each aluminum alloy sheet were removed by mechanical polishing to a depth of 5 μm to form mirror surfaces.

(2) The surface of each test piece was observed with a scanning electron microscope (JSM-T330, manufactured by JEOL Ltd.) at a magnification of 500×. The regions of Al—Mn—Fe—Si-based intermetallic compounds on the component image were extracted to create an image map indicating the distribution of the Al—Mn—Fe—Si-based intermetallic compounds.

(3) Measurements were made on the above image in 20 fields of view using a structure photograph obtained by image analysis (high-speed image processor TOSPIX-II, manufactured by Toshiba Corporation) of the extracted regions. The lengths of the longest portions (maximum lengths) of the Al—Mn—Fe—Si-based intermetallic compounds and the number of the grains per unit area (1 mm$^2$) were statistically measured to determine the number density of Al—Mn—Fe—Si-based intermetallic compound with a maximum length of 8 to 15 μm per unit area.

In addition to the Al—Mn—Fe—Si-based intermetallic compound, other intermetallic compound, such as Mg—Si-based intermetallic compound, can occur in the composition of the aluminum alloys according to the present invention. The Al—Mn—Fe—Si-based intermetallic compound can be discriminated from other intermetallic compound on the component image by scanning electron microscopy.

[B. Measurement of Arithmetic Average Roughness Ra of Surface of Aluminum Alloy Sheet]

The surface roughness of the test pieces of each aluminum alloy sheet was measured with a surface roughness measuring instrument (Surfcorder SE-30D, manufactured by Kosaka Laboratory Ltd.). The surface of each test piece was scanned in a direction perpendicular to a rolling direction to determine the arithmetic average roughness Ra (JIS B 0601).

[C. Measurement of Average Oxide Film Thickness]

The average thickness of the oxide film formed on each aluminum alloy sheet was measured with an auger electron spectrometer (Type: 310D, manufactured by VG Scientific). The concentration of oxygen from the surface of the sheet in the depth direction was measured to determine the depth at which the relative oxygen concentration was 20%. The depth was assumed as the thickness of the oxide film. This measurement was made at five spots on each test piece, and the measured values were averaged to determine the average oxide film thickness.

[D. Evaluation of Ironability]

The ironability of the DI cans was evaluated from the number of cans that caused tear off, where "Good" indicates that no can ruptured, "Fair" (slightly defective but satisfactory in quality) indicates that one or two cans ruptured, and "Poor" indicates that three or more cans ruptured.

[E. Evaluation of ERV Properties]

The ERV properties of the bottle cans were evaluated by filling each can with a solution containing 1% saline and 0.02% surfactant, applying a direct voltage of 6.2 V between the solution and the outer surface of the can, and measuring the current four seconds after the voltage application with an ammeter. The averages of the measured values for the individual types of bottle cans (number of cans of each type n: 20) were determined to be poor if the values exceeded 10 mA.

[F. Evaluation of Leakage Rate]

The leakage rate of each type of bottle can (number of cans n: 20) was evaluated by introducing carbonated water into the cans, sealing the cans with caps, leaving the cans upside down for 24 hours, and observing whether the contents leaked. The leakage rate was determined as the ratio (m/20) of the number of cans leaking (m) to the number of the bottle cans (n: 20).

Referring to Table 1, Examples 1 to 6 met the requirements for the present invention.

The content of Si in Comparative Example 7 was below the lower limit of the requirements for the present invention while that in Comparative Example 8 was above the upper limit of the requirements for the present invention. The content of Fe in Comparative Example 9 was below the lower limit of the requirements for the present invention while that in Comparative Example 10 was above the upper limit of the requirements for the present invention. In Comparative Example 10, additionally, the number density of Al—Mn—Fe—Si-based intermetallic compound with a maximum length of 8 to 15 μm exceeded the upper limit according to the present invention. The content of Mn in Comparative Example 11 was below the lower limit of the requirements for the present invention while that in Comparative Example 12 was above the upper limit of the requirements for the present invention. In Comparative Example 12, additionally, the number density of Al—Mn—Fe—Si-based intermetallic compound with a maximum length of 8 to 15 μm exceeded the upper limit according to the present invention.

The content of Mg in Comparative Example 13 was below the lower limit of the requirements for the present invention while that in Comparative Example 14 was above the upper limit of the requirements for the present invention. The content of Cu in Comparative Example 15 was below the lower limit of the requirements for the present invention while that in Comparative Example 16 was above the upper limit of the requirements for the present invention. In Comparative Example 17, casting was performed at a lower rate than usual in the process of producing the aluminum alloy sheet to promote the precipitation and growth of Al—Mn—Fe—Si-based intermetallic compounds, though the composition in this example was similar to those in Examples 1 to 6. In Comparative Examples 18 and 19, the surface roughness was above the upper limit of the requirements for the present invention. In Comparative Examples 20 and 21, the average oxide film thickness was above the upper limit of the requirements for the present invention.

The results in Table 1 of Examples 1 to 6, which meet the requirements for the present invention, and Comparative Examples 7 to 21, which do not meet the requirements for the present invention, are summarized below. In Examples 1 to 6, as shown in Table 1, the ironability was "Good", the ERV properties were below 10 mA (0.0 mA or trace amounts, i.e. 1.7 mA and 0.9 mA), and the leakage rates were "0/20". These results were all excellent.

On the other hand, the ironability, the ERV properties, and the leakage rates were poor in Comparative Examples 8, 10, and 12, in which the content of Si, Fe, or Mn was excessively high. In Comparative Examples 8, 10, and 12, an excessively high content of Si, Fe, or Mn had a tendency to increase the size and number density of Al—Mn—Fe—Si-based intermetallic compound. In particular, large Al—Mn—Fe—Si-based intermetallic compounds with a maximum length exceeding 20 μm readily caused tear off, and resulted in an excessive mechanical strength of the cans which impaired the formability and therefore decreased the ironability. In addition, the excessively high content of Si, Fe, or Mn resulted in an excessive mechanical strength of the cans which impaired the formability and therefore decreased the ironability. Furthermore, the leakage rates were high because an increased amount of dust produced from the die used in DI process caused longitudinal streaks on the cans.

In Comparative Examples 7, 9, and 11, in which the content of Si, Fe, or Mn was excessively low, the ironability was poor. In Comparative Examples 7, 9, and 11, the excessively low content of Si, Fe, or Mn had a tendency to decrease the size and number density of Al—Mn—Fe—Si-based intermetallic compound. That is, the ironability deteriorated because the Al—Mn—Fe—Si-based intermetallic compounds lost their function as a solid lubricant between the cans and the die to result in increased adhesiveness therebetween.

In Comparative Examples 14 and 16, in which the content of Mg or Cu was excessively high, the ironability was poor. In Comparative Examples 14 and 16, the ironability deteriorated because of extremely high mechanical strength of the cans.

In Comparative Examples 13 and 15, in which the content of Mg or Cu was excessively low, the ironability and the leakage rates were satisfactory, though the mechanical strength of the cans was extremely low for lack of Mg or Cu. Obviously, therefore, the cans of Comparative Examples 13 and 15 are of no practical use as containers.

The bottle cans of Comparative Examples 17 to 21 were defective because of high leakage rates. In these comparative examples, the number density of the intermetallic compound, the surface roughness, and the average oxide film thickness were excessively high. The surface of the die was therefore readily roughened in ironing to produce dust which caused longitudinal streaks on the cans to increase the leakage rate of the bottle cans filled with carbonated water. In Comparative Example 17, particularly, the surface of the die was readily roughened because of the high number density of Al—Mn—Fe—Si-based intermetallic compound with a maximum length of 8 to 15 μm per unit area. As a result, longitudinal streaks occurred readily on the outer surfaces of the container products. In addition, coating defects occurred readily on the inner surfaces of the bottle cans to deteriorate the ERV properties.

In Examples 1 to 6, as described above, excellent ironability and leakage rates were achieved with no longitudinal streaks occurring in necking by controlling the individual factors within the proper ranges according to the requirements for the present invention. In Comparative Examples 7 to 21, which did not meet the requirements for the present invention, the ironability, the ERV properties, and the leakage rate were poor, and many longitudinal streaks were observed.

Second Set of Examples

A second set of examples of the aluminum alloy sheet according to the present invention will now be specifically described in contrast with comparative examples that do not meet the requirements for the present invention.

An ingot of Al—Mn-based 3004 alloy (JIS 4000) was subjected to the steps of normal casting, homogenization, hot rolling, and cold rolling to prepare test pieces of varying types of aluminum alloy sheets with a thickness of 0.32 mm. The formability of these test pieces was evaluated.

Table 2 shows the evaluation results of the composition, the number density of Al—Mn—Fe—Si-based intermetallic compound with a maximum length of 10 μm or more per unit area, the arithmetic average roughness Ra, the average oxide film thickness, the ironability, the ERV properties, and the leakage rate for the test pieces of each type of aluminum alloy sheet.

In the second set of examples, in Table 2, the aluminum alloy sheets of Examples 22 to 27 contained 0.1% to 0.4% by mass of Cu, 0.5% to 1.5% by mass of Mg, 0.7% to 1.5% by mass of Mn, 0.35% to 0.50% by mass of Fe, and 0.1% to 0.3% by mass of Si, and the balance is composed of Al and unavoidable impurities. These aluminum alloy sheets included Al—Mn—Fe—Si-based intermetallic compounds with a maximum length of 10 μm or more at a number density of 67 grains/mm$^2$ or less. In addition, oxide films formed on the aluminum alloy sheets had an average thickness of 30 nm or less. Furthermore, the arithmetic average roughness Ra of the surfaces of the aluminum alloy sheets was 0.30 to 0.45 μm. On the other hand, the aluminum alloy sheets of Comparative Examples 28 to 42 did not meet the above requirements for the present invention.

The individual types of test pieces having the properties shown in Table 2 were prepared under varying conditions, for example varying temperatures and processing times, at the individual steps of casting, homogenization, hot rolling, and cold rolling. The averages of the conditions were as follows: homogenization: homogenization temperature=590° C.; hot rolling: hot finish rolling/coiling temperature=320° C.; cold rolling: cold rolling/coiling temperature=140° C.; roll surface roughness Ra=0.48 μm.

Subsequently, the aluminum alloy sheets shown in Table 2 were used to produce DI cans as follows.

The aluminum alloy sheets were subjected to cupping to prepare cans having a blank diameter of 140 mm and a cup diameter of 90 mm. These cans were then subjected to redrawing at 250 spm and to ironing three times with a final ironing ratio of 39% to produce DI cans having a thickness of 105 μm, a body diameter of 66 mm, and a height of 123 mm.

In this process, 10,000 DI cans were continuously produced. Of the cans produced by the continuous processing, the final 20 cans were washed and subjected to zirconium phosphate conversion coating. The inner surfaces of the cans were then coated with an acrylic-modified epoxy paint by spraying. The cans were necked (into the shape of the bottle can shown in FIG. 1; degree of diameter reduction: 42%) and were threaded to produce bottle cans.

In the same manner as in the first set of examples, the test pieces, the DI cans, and the bottle cans were evaluated for the following items: A. the number density of Al—Mn—Fe—Si-based intermetallic compound with a maximum length of 10 μm or more per unit area; B. the arithmetic average roughness Ra of the surfaces of the aluminum alloy sheets; C. the measurement of the average oxide film thickness; D. the evaluation of ironability; E. the evaluation of ERV properties; and F. leakage rate. Table 2 shows the evaluation results.

In Table 2, Examples 22 to 27 were within the numerical ranges according to the present invention.

The content of Si in Comparative Example 28 was below the lower limit of the numerical range according to the present invention while that in Comparative Example 29 was above the upper limit of the numerical range according to the present invention. In Comparative Example 29, additionally, the number density of Al—Mn—Fe—Si-based intermetallic compound with a maximum length of 10 μm or more per unit area exceeded the upper limit according to the present invention. The content of Fe in Comparative Example 30 was below the lower limit of the numerical range according to the present invention while that in Comparative Example 31 was

TABLE 2

| | | Composition (mass %) | | | | | Intermetallic compound with maximum length of 10 μm or more | Surface roughness Ra | Average oxide film thickness | | ERV properties | Leakage |
|---|---|---|---|---|---|---|---|---|---|---|---|---|
| Category | No. | Si | Fe | Mn | Mg | Cu | (grains/mm$^2$) | (μm) | (nm) | Ironability | (mA) | rate |
| Example | 22 | 0.27 | 0.44 | 0.90 | 0.90 | 0.20 | 25 | 0.38 | 18 | Good | 0.0 | 0/20 |
| | 23 | 0.25 | 0.42 | 0.88 | 0.91 | 0.23 | 30 | 0.38 | 18 | Good | 0.0 | 0/20 |
| | 24 | 0.27 | 0.48 | 1.15 | 1.20 | 0.23 | 41 | 0.38 | 18 | Good | 0.0 | 0/20 |
| | 25 | 0.29 | 0.43 | 0.90 | 0.92 | 0.21 | 32 | 0.38 | 18 | Good | 0.0 | 0/20 |
| | 26 | 0.29 | 0.48 | 1.45 | 0.91 | 0.20 | 65 | 0.38 | 18 | Good | 1.7 | 0/20 |
| | 27 | 0.28 | 0.47 | 1.32 | 0.95 | 0.21 | 58 | 0.38 | 18 | Good | 0.9 | 0/20 |
| Comparative example | 28 | 0.08 | 0.44 | 0.90 | 0.90 | 0.20 | 30 | 0.38 | 18 | Fair | 0.0 | 1/20 |
| | 29 | 0.50 | 0.44 | 0.90 | 0.90 | 0.23 | 87 | 0.38 | 18 | Fair | 12.7 | 2/20 |
| | 30 | 0.27 | 0.15 | 0.90 | 0.90 | 0.20 | 41 | 0.38 | 18 | Fair | 1.8 | 0/20 |
| | 31 | 0.26 | 0.85 | 0.89 | 0.90 | 0.22 | 110 | 0.38 | 18 | Fair | 15.5 | 5/20 |
| | 32 | 0.27 | 0.44 | 0.33 | 0.90 | 0.20 | 9 | 0.38 | 18 | Poor | 0.0 | 0/20 |
| | 33 | 0.27 | 0.44 | 1.55 | 0.90 | 0.22 | 166 | 0.38 | 18 | Fair | 22.8 | 3/20 |
| | 34 | 0.27 | 0.44 | 0.90 | 0.30 | 0.20 | 20 | 0.38 | 18 | Good | 0.0 | 0/20 |
| | 35 | 0.26 | 0.44 | 0.89 | 2.05 | 0.20 | 15 | 0.38 | 18 | Poor | 0.0 | 0/20 |
| | 36 | 0.27 | 0.44 | 0.90 | 0.89 | 0.04 | 21 | 0.38 | 18 | Good | 0.0 | 0/20 |
| | 37 | 0.27 | 0.44 | 0.91 | 0.90 | 0.42 | 30 | 0.38 | 18 | Poor | 0.1 | 0/20 |
| | 38 | 0.27 | 0.44 | 0.90 | 0.95 | 0.20 | 68 | 0.38 | 18 | Good | 14.3 | 3/20 |
| | 39 | 0.26 | 0.42 | 0.92 | 0.94 | 0.19 | 24 | 0.49 | 16 | Good | 0.0 | 2/20 |
| | 40 | 0.26 | 0.42 | 0.92 | 0.94 | 0.19 | 24 | 0.59 | 15 | Good | 0.2 | 4/20 |
| | 41 | 0.26 | 0.42 | 0.92 | 0.94 | 0.19 | 24 | 0.41 | 35 | Good | 0.0 | 2/20 |
| | 42 | 0.26 | 0.42 | 0.92 | 0.94 | 0.19 | 24 | 0.42 | 47 | Good | 0.0 | 3/20 |

above the upper limit of the numerical range according to the present invention. In Comparative Example 31, additionally, the number density of Al—Mn—Fe—Si-based intermetallic compound with a maximum length of 10 μm or more per unit area exceeded the upper limit according to the present invention. The content of Mn in Comparative Example 32 was below the lower limit of the numerical range according to the present invention while that in Comparative Example 33 was above the upper limit of the numerical range according to the present invention. In Comparative Example 33, additionally, the number density of Al—Mn—Fe—Si-based intermetallic compound with a maximum length of 10 μm or more per unit area exceeded the upper limit according to the present invention.

The content of Mg in Comparative Example 34 was below the lower limit of the numerical range according to the present invention while that in Comparative Example 35 was above the upper limit of the numerical range according to the present invention. The content of Cu in Comparative Example 36 was below the lower limit of the numerical range according to the present invention while that in Comparative Example 37 was above the upper limit of the numerical range according to the present invention. In Comparative Example 38, scalping was performed in an amount smaller than usual in the process of producing the aluminum alloy sheet to leave a coarse cell layer containing coarse Al—Mn—Fe—Si-based intermetallic compounds. As a result, the number density of Al—Mn—Fe—Si-based intermetallic compound with a maximum length of 10 μm or more per unit area was above the upper limit of the numerical range according to the present invention. In Comparative Examples 39 and 40, the surface roughness was above the upper limit of the numerical range according to the present invention. In Comparative Examples 41 and 42, the average oxide film thickness was above the upper limit of the requirements for the present invention.

The results shown in Table 2 are summarized below. In Examples 22 to 27, which meet the requirements for the present invention, the ironability was "Good", the ERV properties were below 10 in A (0.0 mA or trace amounts, i.e. 1.7 mA and 0.9 mA), and the leakage rates were "0/20". These results were all excellent.

On the other hand, the ironability, the ERV properties, and the leakage rates were poor in Comparative Examples 29, 31, and 33, in which the content of Si, Fe, or Mn was above the numerical range according to the present invention. In Comparative Examples 29, 31, and 33, the content of Si, Fe, or Mn above the upper limit of the numerical range according to the present invention had a tendency to increase the size and number density per unit area of Al—Mn—Fe—Si-based intermetallic compound. In particular, large Al—Mn—Fe—Si-based intermetallic compounds with a maximum length exceeding 20 μm readily caused tear off. In addition, the excessively high content of Si, Fe, or Mn resulted in an excessive mechanical strength of the cans which impaired the formability and therefore decreased the ironability. Furthermore, coating defects occurred because an increased amount of dust produced from the die used in DI process readily caused longitudinal streaks on the cans. The defects readily caused the dissolution and corrosion of aluminum, and therefore significantly deteriorated the ERV properties. This resulted in high leakage rates.

In Comparative Examples 28, 30, and 32, in which the content of Si, Fe, or Mn was below the numerical range according to the present invention, the ironability was poor. In Comparative Examples 28, 30, and 32, the excessively low content of Si, Fe, or Mn had a tendency to decrease the size and number density per unit area of Al—Mn—Fe—Si-based intermetallic compound exposed at the surfaces of the aluminum alloy sheets. That is, the ironability deteriorated because the Al—Mn—Fe—Si-based intermetallic compounds lost their effect as a solid lubricant between the cans and a die to result in increased adhesiveness therebetween which readily caused the seizure of the cans to the die.

In Comparative Examples 35 and 37, in which the content of Mg or Cu was above the upper limit of the numerical range according to the present invention, the ironability was poor. In Comparative Examples 35 and 37, the ironability deteriorated because the excessively high content of Mg or Cu extremely increased the mechanical strength of the cans.

In Comparative Examples 34 and 36, in which the content of Mg or Cu was below the numerical range according to the present invention, the ironability and the leakage rates were satisfactory, though the mechanical strength of the cans was significantly low because of the excessively low content of Mg or Cu. Obviously, therefore, the cans of Comparative Examples 34 and 36 are of no practical use as containers.

The bottle cans of Comparative Examples 38 were defective because of poor ERV properties and high leakage rate. In this comparative example, the number density of the Al—Mn—Fe—Si-based intermetallic compound per unit area was above the numerical range according to the present invention. The surface of the die was therefore readily roughened to cause longitudinal streaks on the outer surfaces of the container products. In addition, coating defects occurred readily to cause streaks on the inner surfaces of the bottle cans. As a result, the ERV properties deteriorated, and the leakage rate rose.

The bottle cans of Comparative Examples 39 to 42 were defective because of high leakage rates. In Comparative Examples 39 and 40, particularly, the arithmetic average roughness Ra was above the numerical range according to the present invention. In Comparative Examples 41 and 42, the average oxide film thickness was above the numerical range according to the present invention. The surface of the die was therefore readily roughened in ironing to produce a large amount of dust which caused longitudinal streaks on the cans to increase the leakage rate of the bottle cans filled with carbonated water.

In Examples 22 to 27, as described above, excellent ironability and leakage rates were achieved with no poor ERV properties by controlling the contents of Cu, Mg, Mn, Fe, and Si, the number density of Al—Mn—Fe—Si-based intermetallic compound with a maximum length of 10 μm or more per unit area, the average oxide film thickness, and the arithmetic average roughness Ra within the proper ranges. In Comparative Examples 28 to 42, which did not meet the requirements for the present invention, the ironability, the ERV properties, and the leakage rate were poor.

Third Set of Examples

Next, the following test was carried out to demonstrate the relationship between the number density of Al—Mn—Fe—Si-based intermetallic compound per unit area, average oxide film thickness, and arithmetic average roughness Ra of the aluminum alloy sheets (hereinafter simply referred to as alloy sheets) and the production conditions of the alloy sheets.

1. Test Method

Al—Mn-based alloy was subjected to the steps of melting, casting (slab thickness: 600 mm; slab width: 1,500 mm), homogenization, hot rolling, and cold rolling to produce alloy sheets having a thickness of 0.32 mm. In these steps, the following production conditions were controlled:

[Melting] melt composition

[Casting] casting rate and slab scalping

[Homogenization] homogenization temperature

[Hot rolling] hot finish rolling/coiling temperature

[Cold rolling] cold rolling/coiling temperature and roll surface roughness (arithmetic average roughness)

Measurements were made on the resultant alloy sheets by the same methods as above. Table 3 shows the results of the number density of Al—Mn—Fe—Si-based intermetallic compound per unit area, average oxide film thickness, and arithmetic average roughness Ra of the alloy sheets.

TABLE 3

| Alloy sheet No. | Production conditions: Melting, Composition (mass %) Si | Fe | Mn | Mg | Cu | Casting: Casting rate (mm/min) | Slab scalping (mm) | Homogenization (° C.) | Hot rolling: Coiling temperature (° C.) | Cold rolling: Coiling temperature (° C.) | Roll surface roughness Ra (μm) | Test results: Number density of intermetallic compound (grains/mm²) 8 to 15 μm | 10 μm or more | Arithmetic average roughness Ra (μm) | Average oxide film thickness (nm) |
|---|---|---|---|---|---|---|---|---|---|---|---|---|---|---|---|
| Invention product 1 | 0.26 | 0.43 | 0.89 | 0.92 | 0.21 | 50 | 30 | 590 | 320 | 140 | 0.48 | 99 | 27 | 0.38 | 18 |
| 2 | 0.26 | 0.43 | 0.89 | 0.92 | 0.21 | 50 | 20 | 590 | 320 | 140 | 0.48 | 110 | 30 | 0.38 | 18 |
| 3 | 0.28 | 0.42 | 0.91 | 0.92 | 0.19 | 45 | 30 | 590 | 320 | 140 | 0.48 | 102 | 28 | 0.38 | 18 |
| 4 | 0.28 | 0.42 | 0.91 | 0.92 | 0.19 | 45 | 20 | 590 | 320 | 140 | 0.48 | 116 | 32 | 0.38 | 18 |
| Comparative product 5 | 0.27 | 0.84 | 0.90 | 0.92 | 0.21 | 45 | 20 | 590 | 320 | 140 | 0.48 | 208 | 105 | 0.38 | 18 |
| 6 | 0.26 | 0.43 | 1.57 | 0.91 | 0.20 | 45 | 20 | 590 | 320 | 140 | 0.48 | 194 | 169 | 0.38 | 18 |
| 7 | 0.26 | 0.45 | 0.90 | 0.93 | 0.22 | 30 | 20 | 590 | 320 | 140 | 0.48 | 182 | 71 | 0.38 | 18 |
| 8 | 0.27 | 0.45 | 0.89 | 0.91 | 0.20 | 25 | 20 | 590 | 320 | 140 | 0.48 | 183 | 72 | 0.38 | 18 |
| 9 | 0.26 | 0.43 | 0.89 | 0.92 | 0.21 | 50 | 5 | 590 | 320 | 140 | 0.48 | 183 | 69 | 0.38 | 18 |
| 10 | 0.28 | 0.42 | 0.91 | 0.92 | 0.19 | 45 | 5 | 590 | 320 | 140 | 0.48 | 184 | 70 | 0.38 | 18 |
| 11 | 0.26 | 0.44 | 0.88 | 0.93 | 0.22 | 30 | 5 | 590 | 320 | 140 | 0.48 | 190 | 80 | 0.38 | 18 |
| 12 | 0.27 | 0.45 | 0.89 | 0.91 | 0.20 | 25 | 5 | 590 | 320 | 140 | 0.48 | 192 | 83 | 0.38 | 18 |
| 13 | 0.27 | 0.43 | 0.90 | 0.92 | 0.19 | 45 | 20 | 590 | 320 | 140 | 0.59 | 111 | 33 | 0.48 | 16 |
| 14 | 0.27 | 0.43 | 0.90 | 0.92 | 0.19 | 45 | 20 | 590 | 320 | 140 | 0.68 | 110 | 32 | 0.58 | 16 |
| 15 | 0.27 | 0.43 | 0.90 | 0.92 | 0.19 | 45 | 20 | 620 | 320 | 140 | 0.50 | 113 | 33 | 0.40 | 33 |
| 16 | 0.27 | 0.43 | 0.90 | 0.92 | 0.19 | 45 | 20 | 620 | 350 | 170 | 0.52 | 114 | 34 | 0.41 | 46 |

2. Test Results

In Table 3, alloy sheets 1 to 4 (invention products) met the requirements for the present invention, and alloy sheets 5 to 16 (comparative products) did not meet the requirements for the present invention. The test results are summarized below.

(1-1) The number density of Al—Mn—Fe—Si-based intermetallic compound per unit area is controlled with the melt composition in melting, particularly the contents of Fe and Mn.

The content of Fe in the alloy sheet 5 (comparative product) was 0.84% by mass, which was higher than that in the alloy sheets 1 to 4 (invention products) and exceeded the predetermined range (0.2% to 0.7% by mass) according to the present invention. As a result, the number density of Al—Mn—Fe—Si-based intermetallic compound per unit area in the alloy sheet exceeded the predetermined range according to the present invention, namely 179 or fewer grains with a maximum length of 8 to 15 μm per square millimeter or 67 or fewer grains with a maximum length of 10 μm or more per square millimeter.

In addition, the content of Mn in the alloy sheet 6 (comparative product) was 1.57% by mass, which was higher than that in the alloy sheets 1 to 4 (invention products) and exceeded the predetermined range (0.5% to 1.5% by mass) according to the present invention. As a result, the number density of Al—Mn—Fe—Si-based intermetallic compound per unit area in the alloy sheet exceeded the predetermined range according to the present invention.

(1-2) The number density of Al—Mn—Fe—Si-based intermetallic compound per unit area is controlled with the rate of casting and the degree of scalping.

(1) For the alloy sheets 7, 8, 11, and 12 (comparative products), casting was performed at 30 or 25 mm/min, which was lower than that for the alloy sheets 1 to 4 (invention products), namely 45 or 50 mm/min. As a result, the number density of Al—Mn—Fe—Si-based intermetallic compound per unit area in the alloy sheets exceeded the predetermined range according to the present invention.

The lower casting rates produced thicker coarse cell layers including coarse intermetallic compounds in the vicinity of the surfaces of the slabs, and varied the shape of the slabs to expand the center thereof. As a result, the coarse cell layers were incompletely removed in scalping to leave coarse intermetallic compounds in the vicinity of the surfaces of the slabs.

(2) For the alloy sheets 9 to 12 (comparative products), scalping was performed to a depth of 5 mm, which was smaller than that for the alloy sheets 1 to 4 (invention products), namely a depth of 20 or 30 mm. As a result, the number density of Al—Mn—Fe—Si-based intermetallic compound per unit area in the alloy sheets exceeded the predetermined range according to the present invention.

Coarse cell layers in the vicinity of the surfaces of the slabs were incompletely removed because of the smaller depths of scalping to leave coarse intermetallic compounds in the vicinity of the surfaces of the slabs.

(1-3) The average oxide film thickness is controlled with the homogenization temperature, the hot finish rolling/coiling temperature, and the cold rolling/coiling temperature.

The alloy sheets 15 and 16 (comparative products) were processed at a homogenization temperature of 620° C., a hot finish rolling/coiling temperature of 350° C., and a cold rolling/coiling temperature of 170° C. These temperatures were higher than those for the alloy sheets 1 to 4 (invention products), namely a homogenization temperature of 590° C., a hot finish rolling/coiling temperature of 320° C., and a cold rolling/coiling temperature of 140° C. As a result, the average oxide film thickness of the alloy sheets exceeded the predetermined range (30 nm or less) according to the present invention.

(1-4) The arithmetic average roughness Ra is controlled with the arithmetic average roughness Ra of the surface of the roll used in cold rolling.

For the alloy sheets 13 and 14 (comparative products), the arithmetic average roughness Ra of the surface of the roll used in cold rolling was 0.59 or 0.68 μm, which was higher than that of the surface of the roll used for the alloy sheets 1 to 4 (invention products), namely 0.48 μm. As a result, the arithmetic average roughness Ra of the surfaces of the alloy sheets exceeded the predetermined range (0.30 to 0.45 μm) according to the present invention.

The present invention is not limited to the above embodiments; naturally, various modifications are permitted within the scope of the present invention. In the above embodiments, for example, hot rolling is performed before cold rolling. In the present invention, alternatively, hot rolling may be performed before annealing and then cold rolling, or may be performed before cold rolling, annealing, and then final cold rolling.

What is claimed is:

1. An aluminum alloy sheet comprising:

0.1% to 0.4% by mass of Cu, 0.5% to 1.5% by mass of Mg, 0.7% to 1.5% by mass of Mn, 0.35% to 0.50% by mass of Fe, and 0.1% to 0.3% by mass of Si, wherein a number density of Al—Mn—Fe—Si-based intermetallic compound having a maximum length of 8 to 15 μm per unit area is 179 grains/$mm^2$ or less;

a number density of Al—Mn—Fe—Si-based intermetallic compound having a maximum length of 10 μm or more per unit area is 67 grains/$mm^2$ or less;

an oxide film having an average thickness of 30 nm or less is formed on the surface of the aluminum alloy sheet; and an arithmetic average roughness Ra of the surface of the aluminum alloy sheet is 0.30 to 0.45 μm.

2. An aluminum alloy container produced from an aluminum alloy sheet comprising:

0.1% to 0.4% by mass of Cu, 0.5% to 1.5% by mass of Mg, 0.7% to 1.5% by mass of Mn, 0.35% to 0.50% by mass of Fe, and 0.1% to 0.3% by mass of Si, wherein a number density of Al—Mn—Fe—Si-based intermetallic compound having a maximum length of 8 to 15 μm per unit area in the aluminum alloy sheet is 179 grains/$mm^2$ or less;

a number density of Al—Mn—Fe—Si-based intermetallic compound having a maximum length of 10 μm or more per unit area is 67 grains/$mm^2$ or less;

an oxide film having an average thickness of 30 nm or less is formed on the surface of the aluminum alloy sheet; and an arithmetic average roughness Ra of the surface of the aluminum alloy sheet is 0.30 to 0.45 μm, the aluminum alloy container having a cylindrical body portion and a neck portion formed by necking, wherein $(D1-D2)/D1\times100\geqq30$, wherein D1 is the diameter of the body portion and D2 is the diameter of the neck portion.

3. The aluminum alloy container according to claim 2, wherein an enamel rate value is 10 mA or less.

* * * * *